US007038216B1

(12) United States Patent
Dahl et al.

(10) Patent No.: US 7,038,216 B1
(45) Date of Patent: May 2, 2006

(54) ELECTROSTATIC SHAPE-SHIFTING ION OPTICS

(75) Inventors: David A. Dahl, Idaho Falls, ID (US); Jill R. Scott, Idaho Falls, ID (US); Anthony D. Appelhans, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 1 day.

(21) Appl. No.: 11/021,380

(22) Filed: Dec. 23, 2004

(51) Int. Cl.
*H01J 27/00* (2006.01)

(52) U.S. Cl. ..... 250/423 R; 250/281; 250/282; 250/288; 250/292

(58) Field of Classification Search ..... 250/281, 250/288, 292, 423 R
See application file for complete search history.

(56) References Cited

U.S. PATENT DOCUMENTS 5,796,100 A * 8/1998 Palermo ..... 250/292
6,627,883 B1 9/2003 Wang et al.
6,646,258 B1 11/2003 Russ
6,649,911 B1 11/2003 Kawato
6,670,606 B1 12/2003 Verentchikov et al.
6,674,067 B1 * 1/2004 Grosshans et al. ..... 250/282
6,674,071 B1 1/2004 Franzen et al.
6,690,005 B1 2/2004 Jenkins et al.
6,700,116 B1 3/2004 Taniguchi
6,713,757 B1 * 3/2004 Tanner et al. ..... 250/288

* cited by examiner

*Primary Examiner*—Nikita Wells
*Assistant Examiner*—Johnnie L Smith, II
(74) *Attorney, Agent, or Firm*—Dahl Osterloth, LLP

(57) ABSTRACT

Electrostatic shape-shifting ion optics includes an outer electrode that defines an interior region between first and second opposed open ends. A first inner electrode is positioned within the interior region of the outer electrode at about the first open end. A second inner electrode is positioned within the interior region of the outer electrode at about the second open end. A first end cap electrode is positioned at about a first open end of the first inner electrode so that the first end cap electrode substantially encloses the first open end of the first inner electrode. A second end cap electrode is positioned at about a second open end of the second inner electrode so that the second end cap electrode substantially encloses the second open end of the second inner electrode. A voltage source operatively connected to each of the electrodes applies voltage functions to each of the electrodes to produce an electric field within an interior space enclosed by the electrodes.

23 Claims, 3 Drawing Sheets

ELECTROSTATIC SHAPE-SHIFTING ION OPTICS

CONTRACTUAL ORIGIN OF THE INVENTION

This invention was made with United States Government support under Contract No. DE-AC07-99ID13727 awarded by the United States Department of Energy. The United States Government has certain rights in the invention.

TECHNICAL FIELD

This invention relates generally to devices for confining and guiding ions.

BACKGROUND

Devices for confining ions are usually referred to as ion traps and generally utilize electric fields to confine (i.e., hold) ions within a specified region, although some types of ion traps utilize a combination of electric and magnetic fields to confine the ions. Most ion traps utilize specially-shaped electrodes to produce electric fields having shapes that are suitable for confining the ions. For example, a large majority of ion traps used hyperbolically-shaped electrodes to produce or generate quadrupole electric fields that are suitable for confining ions. Because the shape or configuration of the electric field in an ion trap is highly correlated with the shape of the electrodes used to establish the field, the shape of the electric field can be altered or changed by changing the configurations (e.g., shapes and relative spacings) of the electrodes of the ion trap.

The ability of a particular electric field to effectively trap or confine the ions depends on a large number of parameters, including the mass of the ions to be confined as well as the pressure within the ion trap. Therefore, if an ion trap is to function effectively, the ion-confining electric field produced by the ion trap must be tailored to the specific application. For example, an ion trap designed to operate in a high-vacuum environment, such as that associated with ion mass spectrometry, will not function effectively in a higher pressure environment, such as that typically associated with ion mobility spectrometry. Consequently, ion traps designed for use in ion mass spectrometers generally cannot be used in ion mobility spectrometers and vice-versa. Instead, the ion trap must be specifically designed for the particular application.

Devices for guiding ions are often referred to as ion guides and are often used to guide ions from an ion source to an ion trap. As was the case for ion traps, ion guides utilize electric fields to guide ions along a specified path or corridor, although ion guides utilizing a combination of electric and magnetic fields have also been used. A commonly used ion guide design utilizes several pairs of elongated rods or cylinders arranged around a central axis. An electric potential placed on opposed pairs of rods results in the formation of an electric field suitable for confining the ions to an area around the central axis. The ions can be made to move along the axis by imposing a suitable electric field gradient along the axis. As was the case for ion traps, the ability of a given ion guide to function effectively requires that the electric field produced thereby be tailored to the specific application. Therefore, ion guides suitable for use in high-vacuum environments are usually not suitable for use in high pressure applications, and vice-versa. That is, the ion guide must be specifically designed for the particular application.

SUMMARY OF THE INVENTION

Electrostatic shape-shifting ion optic apparatus may comprise an outer electrode that defines an interior region between first and second opposed open ends. A first inner electrode is positioned within the interior region of the outer electrode at about the first open end of the outer electrode. A second inner electrode is positioned within the interior region of the outer electrode at about the second open end of the outer electrode. A first end cap electrode is positioned at about the first open end of the outer electrode so that the first end cap electrode substantially encloses the first open end of the outer electrode. A second end cap electrode is positioned at about the second open end of the outer electrode so that the second end cap electrode substantially encloses the second open end of the outer electrode. A voltage source operatively connected to each of the electrodes applies voltage functions to each of the electrodes to produce an electric field within an interior space enclosed by the electrodes.

A method may comprise providing electrostatic ion optics having an outer electrode, first and second inner electrodes positioned within the outer electrode, and first and second end cap electrodes substantially enclosing respective first and second ends of the outer electrode; and applying a voltage function to each of the electrodes to produce an electric field within an interior space enclosed by the electrostatic ion optics.

BRIEF DESCRIPTION OF THE DRAWING

Illustrative and presently preferred embodiment of the invention are shown in the accompanying drawing in which.

DETAILED DESCRIPTION OF THE PREFERRED EMBODIMENTS

Figure 1:
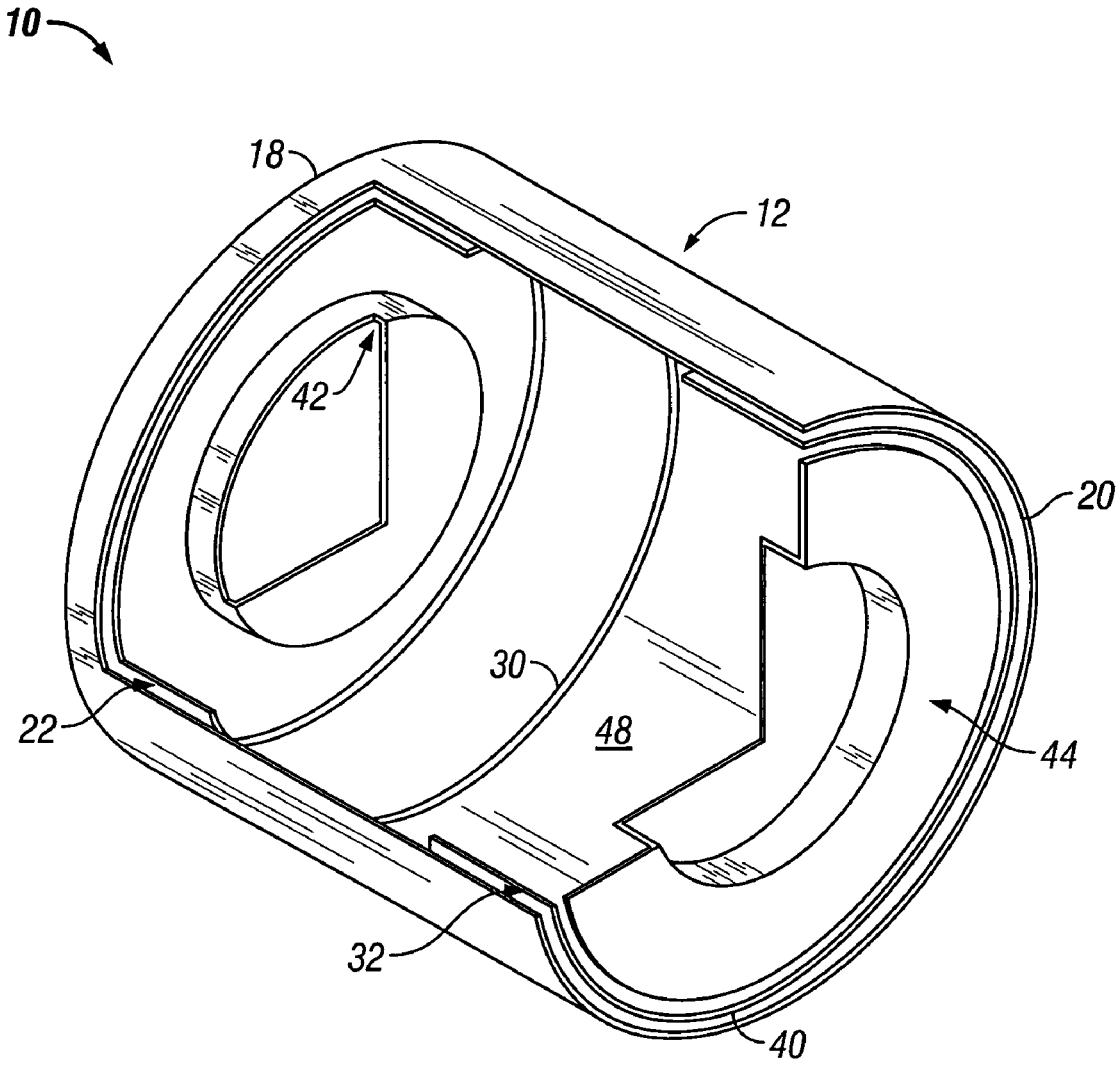
FIG. 1 is a cut-away view in perspective of one embodiment of electrostatic shape-shifting ion optic apparatus.
Figure 2:
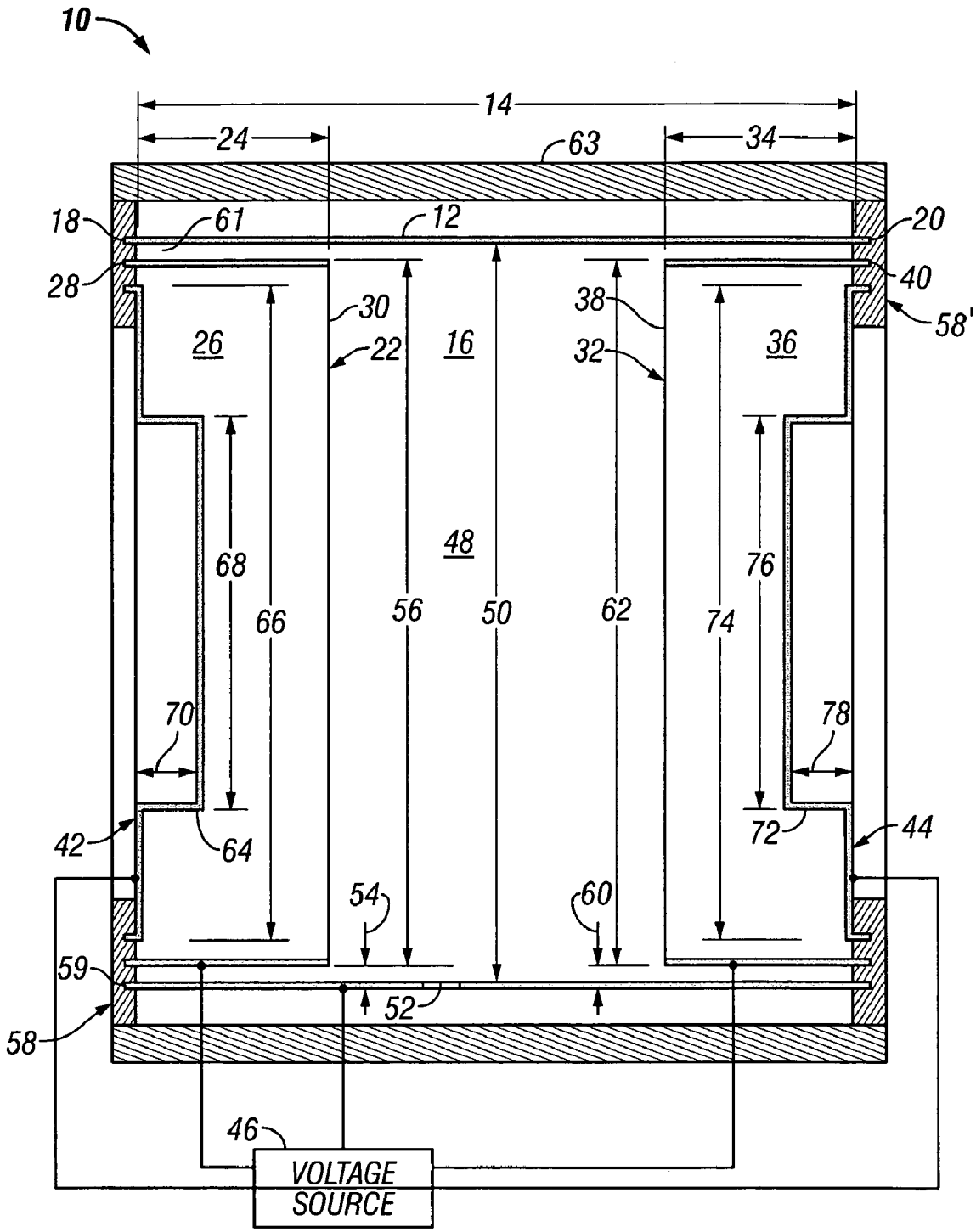
FIG. 2 is a sectional view of the electrostatic shape-shifting ion optic apparatus illustrated in FIG. 1.

Electrostatic shape-shifting ion optics 10 according to one embodiment of the present invention is best seen in FIGS. 1 and 2 and may comprise an outer electrode 12 having a length 14. The outer electrode 12 defines an interior region 16 having first and second opposed open ends 18 and 20. A first inner electrode 22 having a length 24 defines an interior region 26 having first and second opposed open ends 28 and 30. The first inner electrode 22 is positioned within the interior region 16 defined by the outer electrode 12 at about the first open end 18 of outer electrode 12. A second inner electrode 32 having a length 34 defines an interior region 36 having first and second opposed open ends 38 and 40. The second inner electrode 32 is positioned within the interior region 16 defined by the outer electrode 12 at about the second open end 20 of outer electrode 12. A first end cap electrode 42 is positioned at about the first open end 28 of the first inner electrode 22 so that the first end cap electrode 42 substantially encloses the first open end 28 of the first inner electrode 22. A second end cap electrode 44 is positioned at about the second open end 38 of the second inner electrode 32. The second end cap 44 substantially encloses the fist open end 38 of the second inner electrode 32.

A voltage source 46 is connected to each of the outer electrode 12, the first and second inner electrodes 22 and 32, and the first and second end cap electrodes 42 and 44, as best seen in FIG. 2. The voltage source 46 applies voltage functions to the various electrodes 12, 22, 32, 42, and 44 to produce or create an electric field within an interior space 48 enclosed by the electrodes 12, 22, 32, 42, and 44 comprising the electrostatic shape-shifting ion optics 10.

As will be described in greater detail below, any of a wide range of electric fields can be produced within the interior space 48 defined by the electrostatic shape-shifting ion optics 10 by varying the voltage functions that are provided to the various electrodes 12, 22, 32, 42, and 44. For example, and with reference now to FIG. 3, a linear electric field 50 may be established or produced within the interior space 48 of the electrostatic shape-shifting ion optics 10 by applying the appropriate voltage functions to the various electrodes 12, 22, 32, 42, and 44. More specifically, the linear electric field 50 may be produced when the voltage functions applied to the various electrodes 12, 22, 32, 42, and 44 have the relative potentials (as indicated by the relative vertical positions of the various electrodes) illustrated in FIG. 3. Thus, the linear electric field 50 of FIG. 3 may be produced by placing the second inner electrode 32 and second end cap electrode 44 at a base (e.g., ground) potential. The first inner electrode 22 and first end cap electrode 42 are placed at a higher potential. The outer electrode 12 is placed at a potential that is approximately midway between the potential of the first inner electrode 22 and first end cap electrode 42 and the potential of the second inner electrode 32 and the second end cap electrode 44. The linear electric field 50 will allow ions (not shown) contained within the interior space 48 to be generally guided along the interior space 48 in the manner that will be described in greater detail below.

Figure 4:
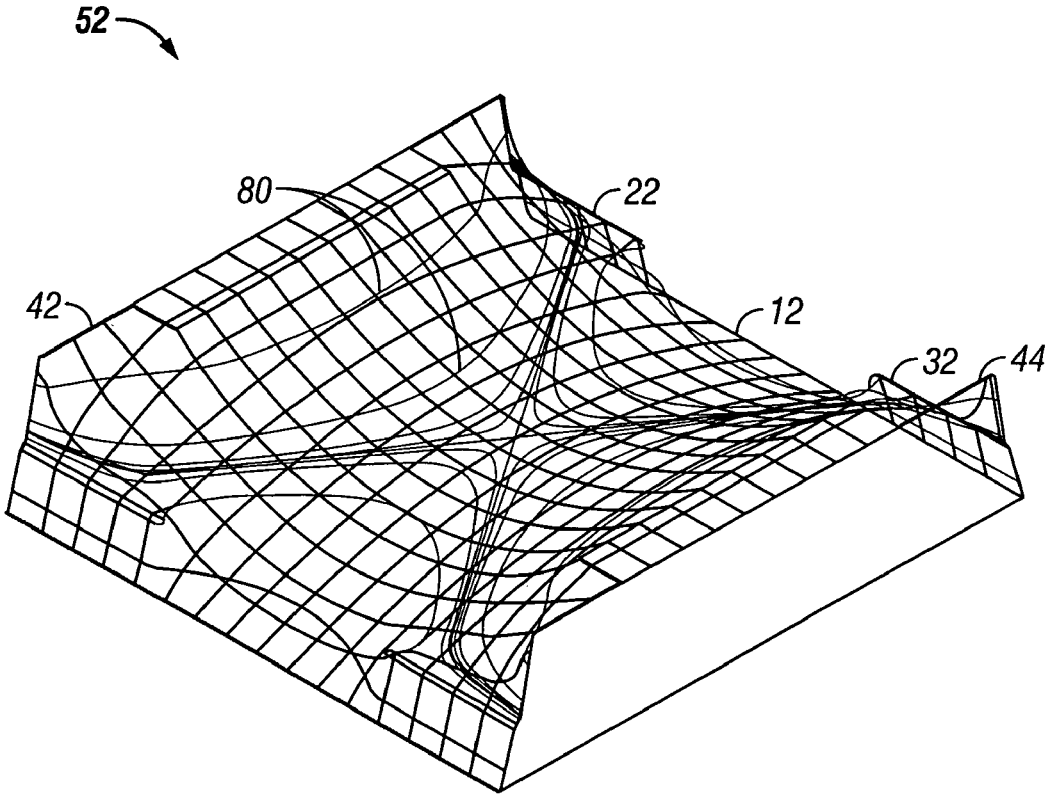
FIG. 4 is a computer-generated plot of a quadrupole electric field produced by the electrostatic shape-shifting ion optic apparatus illustrated in FIG. 1.

Referring now to FIG. 4, a quadrupole electric field 52 may also be produced within the interior space 48 of the electrostatic shape-shifting ion optics 10 by changing the voltage functions provided to the various electrodes 12, 22, 32, 42, and 44. The quadrupole electric field 52 illustrated in FIG. 4 may be produced, for example, by setting the outer electrode 12 at a base (e.g., ground) potential. The first and second end cap electrodes 42 and 44 are together placed at a higher potential, with the first and second inner electrodes 22 and 32 being together placed at a potential that is about midway between the potentials of the first and second end cap electrodes 42 and 44 and the potential of the outer electrode 12. The resulting quadrupole field 52 is useful in containing or "trapping" ions (not shown) contained within the interior space 48 of electrostatic shape-shifting ion optics 10.

The present invention recognizes that any of a wide range of electric fields can be produced by utilizing a "matrix" of electrodes (e.g., many electrodes having specified sizes, shapes, locations, and electric potentials placed thereon). The limits on the shapes of the electric fields that can be produced with a given electrode matrix are dictated by the Laplace equation for electrostatic fields (without space charge):

$$\nabla^2 V=0$$

Thus, any Laplace-allowed electric field may be created by selecting a suitable number of electrodes having specified sizes, shapes, and locations, and then placing suitable electric potentials on the electrodes.

The present invention strikes a balance to obtain some of the matrix flexibility in field generation with a relatively few simply-shaped electrodes (e.g., circular plates and rings). Thus, the electrode configuration shown and described herein may be utilized to produce a wide variety of axisymmetric electric fields, such as hyperbolic fields (including distortable fields), linear, and converging or diverging focusing fields. The shape, aspect ratio, and electrode placement of the present invention have been optimized toward these field-shaping goals. That is, even though the boundary electrodes do not match the desired fields at and near the boundary, the shapes and potentials act to encourage the creation of high-quality versions of the desired fields in the far-field regions (e.g., near the center of the interior space 48 defined by the electrostatic shape-shifting ion optics 10).

The dimensions of the various electrodes have been selected to produce the desired fields specified herein. As will be described in further detail, the dimensions are relative, allowing the ion trap 10 to be scaled so long as the ratios of the dimensions are scaled together. For example, a electrostatic shape-shifting ion optics having twice the size may be easily produced by simply doubling the dimensions of the various electrodes comprising the embodiment shown and described herein. Accordingly, the present invention should not be regarded as limited to the particular dimensions specified herein.

The electric field (e.g., fields 50 and 52) that may be produced within the interior space 48 of the electrostatic shape-shifting ion optics 10 may be easily modified or changed to accommodate any of a wide variety of conditions by changing or modifying the voltage functions applied to the various electrodes 12, 22, 32, 42, and 44. For example, if the electrostatic shape-shifting ion optics 10 is to be utilized to trap ions in a high-vacuum environment, such as that typically associated with ion mass spectrometry, the quadrupole electric field 52 can be finely adjusted to effectively trap ions within the field 52 at the low pressures (e.g., high-vacuum) that are to be expected for the application. However, if it is desired to utilize the electrostatic shape-shifting ion optics 10 in another application involving somewhat higher pressures, the electric field can be changed or modified (e.g., by changing or modifying the voltage functions provided to the electrodes) to allow the electrostatic shape-shifting ion optics 10 to function efficiently in the higher pressure environment. Significantly, there is no need to modify the physical configuration of the various electrodes 12, 22, 32, 42, and 44. Stated another way, the same electrostatic shape-shifting ion optics 10 may be readily used in either low- or higher-pressure applications without the need to change the shape or physical configuration of the various electrodes.

If still higher pressure environments are to be utilized, it may be necessary to enlarge or scale-up the electrostatic shape-shifting ion optics 10 to accommodate the larger ion "clouds" that are experienced with higher pressures. However, because the electrostatic shape-shifting ion optics 10 is scalable, it is a relatively simple matter to enlarge the ion trap 10 by increasing the sizes of the various electrodes, so long as the ratios of the dimensions are maintained during the scaling process.

The linear field 50 can be similarly readily changed or modified to allow the electrostatic shape-shifting ion optics 10 to be effectively used in a wide range of environments without the need to physically re-configure the electrodes. For example, the electrostatic shape-shifting ion optics 10 can be configured for optimal use in any of a wide range of environments by altering or changing the voltage functions provided to the electrodes 12, 22, 32, 42, and 44, thus the electric field (e.g., 50 or 52) produced by the electrodes.

The electric field (e.g., fields 50 and 52) may also be rapidly changed or altered during use (i.e., "on the fly") to cause the ions under the influence of the field to be manipulated or controlled in any of a wide range of manners. For example, a quadrupole field, such as quadrupole electric field 52, may be used to confine ions within the interior space 48. Then, the electric field may be rapidly changed to another type of field (e.g., a linear field 50), to cause the ions contained within the interior space 48 to be manipulated in accordance with the new electric field. The ability to rapidly change the electric field by changing the voltage functions provided to the various electrodes means that higher order, non-linear quadrupolar fields can be dynamically changed to "tune" the electrostatic shape-shifting ion optics 10 for a specific mode of operation, such as for example, to allow for the radial injection of ions, for the long term storage of ions, and for the ejection of ions (e.g., radial or axial ejection of ions). This dynamic adjustability is not possible with ion traps that rely on electrode geometry to provide the quadrupolar field because the geometry can only be optimized for one mode. The versatility and flexibility to produce, with the same electrode configuration, variable electric fields enables the development of novel or improved applications for the electrostatic shape-shifting ion optics 10.

In addition, many applications will benefit from the use oftime-varying (e.g., oscillating) electric fields. For example, and as will be described in greater detail below, time-varying fields may be used to change or alter the distribution of ions contained within the interior region 48, which may be advantageous in certain applications.

Having briefly described the electrostatic shape-shifting ion optics 10 according to one embodiment of the present invention, various exemplary embodiments of the electrostatic shape-shifting ion optics will now be described in detail. However, before proceeding with the description, it should be noted that the electrostatic shape-shifting ion optics could be used in any of a wide range of applications that are now known in the art or that may be developed in the future wherein it is necessary or desirable to confine and otherwise manipulate ions in accordance with the capabilities of the invention shown and described herein. In addition, the electrostatic shape-shifting ion optics 10 may be used to produce any of a wide range of time-invariant and time-varying electric fields, some of which are shown and described herein and others of which could be easily produced by persons having ordinary skill in the art after having become familiar with the teachings provided herein. Consequently, the present invention should not be regarded as limited to the particular applications and to the particular field shapes shown and described herein.

Referring back now to FIGS. 1 and 2, one embodiment of a electrostatic shape-shifting ion optics 10 may comprise an outer electrode 12 that defines or encloses an interior region 16 generally between first and second open ends 18 and 20. The outer electrode 12 may comprise any of a wide range of shapes or configurations suitable for producing the desired fields in conjunction with the other electrodes comprising the electrostatic shape-shifting ion optics 10. As will be described in greater detail below, the particular shape or configuration of the outer electrode 12 that would be suitable for producing the desired electric field or fields can be arrived at (or verified) by using any of a wide range of computer modeling software to model the electric fields resulting from a given combination of electrode shape/configuration as well as applied voltage functions. Consequently, the electrostatic shape-shifting ion optics 10 should not be regarded as limited to an outer electrode 12 having any particular shape or configuration. However, by way of example, in one embodiment, the outer electrode 12 comprises a generally cylindrically-shaped member having a diameter 50 that is substantially constant along the length 14 of the outer electrode 12. The length 14 may be selected to be about 120 mm. The inside diameter 50 may be selected to be about 126 mm.

The outer electrode 12 may be provided with one or more openings 52 therein to allow ions (not shown) to be introduced into the interior space 48. In one embodiment, the opening or openings 52 are provided substantially midway between the first and second open ends 18 and 20 and will allow ions to be substantially radially injected into the interior space 48. Of course, the one or more openings 52 could be provided elsewhere on the outer electrode, depending on the requirements of the particular application. The opening or openings 52 provided in the outer electrode 12 may be completely open, as illustrated in FIG. 2, or may be covered with a material that is transparent to ions (e.g., a wire screen) if so desired. In addition, the opening or openings 52 may be communicatively coupled to an ion source (not shown) to allow ions from the ion source to be conducted to the electrostatic shape-shifting ion optics 10. However, because persons having ordinary skill in the art could readily arrive at a suitable location and configuration (e.g., open or screened) for the opening or openings 52, and could readily provide a suitable ion source, the particular ion source and means for conducting ions for the ion source to the opening or openings 52 provided in the outer electrode 12 will not be described in further detail herein.

The outer electrode 12 may be fabricated from any of a wide range of electrically conductive materials (e.g., metals and metal alloys) suitable for the intended application. Consequently, the present invention should not be regarded as limited to an outer electrode 12 fabricated from any particular material. However, it is generally preferred that the electrically conductive material not form an insulating surface layer of the type formed on many metals, such as aluminum. By way of example, in one embodiment, the outer electrode 12 is formed from a stainless steel alloy. The thickness of the particular material used to form the outer electrode 12 is also not particularly critical, but it is generally preferred that the wall thickness of the outer electrode 12 not exceed about 5–10 mm. By way of example, in one embodiment, the wall thickness of the material used to form the outer electrode 12 is about 1 mm.

in addition, it is important to note that the outer electrode 12 need not be formed from a sheet-like (e.g., solid) material, but could instead be formed from an electrically conductive screen or screen-like material (e.g., electro-formed screen), as would become apparent to persons having ordinary skill in the art after having become familiar with the teachings provided herein. Consequently, the outer electrode 12 should not be regarded as limited to any particular type of material (e.g., conductive metals or metal alloys) having any particular configuration (e.g., solid, sheet-like configurations, or screen-like configurations).

The first inner electrode 22 is positioned within the interior region 16 defined by the outer electrode 12 so that the first open end 28 of first inner electrode 22 is substantially aligned with the first open end 18 of the outer electrode 12. The first inner electrode 22 is made to be somewhat smaller than the outer electrode 12 so that an annular gap 54 is created between the outer electrode 12 and the first inner electrode 22. See FIG. 2.

The first inner electrode 22 is made to have a shape similar to the shape of the outer electrode 12, i.e., so that the first inner electrode 22 will "nest" within the outer electrode 12 in the manner best seen in FIGS. 1 and 2. Thus, in one embodiment wherein the outer electrode 12 comprises a substantially cylindrically-shaped member, the first inner electrode 22 also comprises a substantially cylindrically-shaped member. The length 24 of the first inner electrode 22 is considerably less than the length 14 of the outer electrode 12. More particularly, the length 24 of the first inner electrode 22 is selected to be about 26% of the length 14 of the outer electrode 12. Thus, in one embodiment, the length 24 of the first inner electrode 22 is selected to be about 31 mm.

The outside diameter 56 of the first inner electrode 22 is somewhat smaller than the inside diameter 50 of the outer electrode 12 so as to create the annular gap 54 between the outer electrode 12 and the first inner electrode 22. More specifically, the outside diameter 56 of the first inner electrode 22 is selected to be about 95% of the inside diameter 50 of the outer electrode 12. Thus, in one example embodiment, the outside diameter 56 of the first inner electrode 22 is selected to be about 120 mm. Accordingly, the thickness of the annular gap 54 is about 3 mm.

The first inner electrode 22 may be fabricated from any of a wide range of electrically conductive materials (e.g., metals and metal alloys) suitable for the intended application. Consequently, the present invention should not be regarded as limited to a first inner electrode 22 fabricated from any particular material. However, and as was the case for the outer electrode 12, it is generally preferred that the electrically conductive material not form an insulating surface layer of the type formed on many metals, such as aluminum. By way of example, in one embodiment, the first inner electrode 22 is formed from stainless steel.

It is generally preferred that the particular material used to form the first inner electrode 22 be made as thin as possible to avoid introducing unwanted distortions in the electric field (e.g., 50 or 52) that would result from the use of comparatively thick materials. By way of example, in one embodiment, the wall thickness of the material used to form the first inner electrode 22 is selected to be about 1 mm. As was the case for the outer electrode 12, the first inner electrode 22 need not be formed from a sheet-like (e.g., solid) material, but could instead be formed from an electrically conductive screen or screen-like material, as would become apparent to persons having ordinary skill in the art after having become familiar with the teachings provided herein.

The first inner electrode 22 may be mounted to the outer electrode 12 by any of a wide variety of mounting arrangements that would be suitable for the intended application. Consequently, the present invention should not be regarded as limited to any particular arrangement for mounting the first inner electrode 22 within the outer electrode 12. However, in this regard it should be noted that the mounting arrangement for mounting the first inner electrode 22 within the outer electrode 12 should electrically insulate the two electrodes 12 and 22 if it is desired to place the electrodes 12 and 22 at different electrical potentials. Because in most embodiments it will be desirable to place the to electrodes 12 and 22 at different electrical potentials, at least some of the time, it will be necessary to ensure that the arrangement for mounting the first inner electrode 22 within the outer electrode 12 provides the required degree of electrical insulation.

By way of example, in one embodiment, the first inner electrode 22 is mounted to the outer electrode 12 by means of an insulating end plate 58. The insulating end plate 58 is provided with a plurality of grooves or recesses 59 therein that are sized to receive the various electrodes. For example, in the embodiment shown and described herein, the insulating end plate 58 is provided with grooves 59 sized to receive the outer electrode 12, the first inner electrode 22, as well as the first end cap electrode 42, as best seen in FIG. 2. Alternatively, other mounting arrangements could be used, as would become apparent to persons having ordinary skill in the art after having become familiar with the teachings provided herein.

Before proceeding with the description, it should be noted that the particular mounting arrangement should avoid positioning the insulating material comprising the insulating end plate 58 too close to the end of the annular gap 54 defined between the outer electrode 12 and the second open end 30 of first inner electrode 22 in order to minimize distortions in the electric field that may be caused by any space charge that may be acquired by the insulating material during operation. Generally speaking, such distortions can be minimized by ensuring that the insulating material be located back from the open end of the annular gap 54 by a distance that is at least about 5 times, and more preferably at least about 6 times, the thickness of the annular gap 54. For example, in the embodiment shown and described herein wherein the annular gap 54 is about 3 mm, any insulating material separating the outer electrode 12 and first inner electrode 22 should be located at least about 15 mm back from the second end 30 of the first inner electrode 22 and more preferably by a distance of at least about 18 mm from the second end 30 of the first inner electrode 22. Thus, in the embodiment shown and described herein, the grooves 59 provided in the insulating end plate 58 should not be so deep as to result in the end portion 61 of the insulating end plate 58 from being closer to the second open end 30 of first inner electrode 22 by a distance that is less than about 5 to 6 times the thickness of the annular gap 54.

The insulating end plate 58 may be made from any of a wide range of insulating materials (e.g., ceramics or plastics) suitable for electrically insulating the first inner electrode 22 from the outer electrode 12 and suitable for the particular pressure environment (e.g., high vacuum) in which the electrostatic shape-shifting ion optics 10 is to be utilized. For example, if the electrostatic shape-shifting ion optics 10 is to be utilized in a high-vacuum environment, then the insulating end plate 58 should be fabricated from a material, such as a ceramic, that will not out-gas in the high-vacuum environment. If the electrostatic shape-shifting ion optics 10 are to be utilized in a higher pressure environment, where outgassing of the insulator may not be of primary concern, then the insulating end plate 58 may be fabricated from a polycarbonate or polyimide plastic material. Accordingly, then, the present invention should not be regarded as limited to an insulating end plate 58 comprising any particular material.

The second inner electrode 32 is positioned within the interior region 16 defined by the outer electrode 12 so that the second open end 40 of the second inner electrode 32 is substantially aligned with the second open end 20 of the outer electrode 12. The second inner electrode 32 is made to be somewhat smaller than the outer electrode 12 so that an annular gap 60 is created between the outer electrode 12 and the second inner electrode 32, as best seen in FIG. 2.

In the embodiment shown and described herein, the second inner electrode 32 is basically identical to the first inner electrode 22, although this may not be required in all embodiments. The second inner electrode 32 is made to have a shape similar to the shape of the outer electrode 12, i.e., so that the second inner electrode 32 will "nest" within the outer electrode 12 in the manner best seen in FIGS. 1 and 2. Thus, in one embodiment wherein the outer electrode 12 comprises a substantially cylindrically-shaped member, the second inner electrode 32 also comprises a substantially cylindrically-shaped member. The length 34 of the second inner electrode 32 is less than the length 14 of the outer electrode 12. More particularly, the length 34 of the second inner electrode 32 is selected to be about 26% of the length 14 of the outer electrode 12. Thus, in one embodiment, the length 34 of the second inner electrode 32 is selected to be about 31 mm.

The outside diameter 62 of the second inner electrode 32 is smaller than the inside diameter 50 of the outer electrode 12 so as to create the annular gap 60 between the outer electrode 12 and the second inner electrode 32. More specifically, the outside diameter 62 of the second inner electrode 32 is selected to be about 95% of the inside diameter 50 of the outer electrode 12. Thus, in one example embodiment, the outside diameter 62 of the second inner electrode 32 is about 120 mm. Accordingly, the thickness of the annular gap 60 is about 3 mm.

The second inner electrode 32 may be fabricated from any of a wide range of electrically conductive materials (e.g., metals and metal alloys) suitable for the intended application. Consequently, the present invention should not be regarded as limited to a second inner electrode 32 fabricated from any particular material. However, it is generally preferred that the electrically conductive material not form an insulating surface layer of the type formed on many metals, such as aluminum. By way of example, in one embodiment, the second inner electrode 32 is formed from stainless steel.

As was the case for the first inner electrode 22, it is generally preferred that the particular material used to form the second inner electrode 32 be made as thin as possible to avoid introducing unwanted distortions in the electric field that would result from the use of comparatively thick materials. By way of example, in one embodiment, the wall thickness of the material used to form the second inner electrode 32 is selected to be about 1 mm. As was the case for the outer electrode 12 and the first inner electrode 22, the second inner electrode 32 need not be formed from a sheet-like (e.g., solid) material, but could instead be formed from an electrically conductive screen or screen-like material (e.g., electroformed screen), as would become apparent to persons having ordinary skill in the art after having become familiar with the teachings provided herein.

The second inner electrode 32 may be mounted to the outer electrode 12 by any of a wide variety of mounting arrangements that would be suitable for the intended application. Consequently, the present invention should not be regarded as limited to any particular arrangement for mounting the second inner electrode 32 within the outer electrode 12. However, in this regard it should be noted that the mounting arrangement for mounting the second inner electrode 32 within the outer electrode 12 should electrically insulate the two electrodes 12 and 32 if it is desired to place the electrodes 12 and 32 at different electrical potentials. Because in most embodiments it will be desirable to place the to electrodes 12 and 32 at different electrical potentials, it will be necessary to ensure that the arrangement for mounting the second inner electrode 32 within the outer electrode 12 provides the required degree of electrical insulation. By way of example, in one embodiment, the second inner electrode 32 is mounted to the outer electrode 12 by an insulating end plate 58' that is identical to the insulating end plate 58 already described. See FIG. 2.

First and second end cap electrodes 42 and 44 are positioned at about each open end of the electrostatic shape-shifting ion optics 10, as best seen in FIGS. 1 and 2. More specifically, the first end cap electrode 42 is positioned at about the first open end 28 of the first inner electrode 22. Accordingly, the first end cap electrode 42 substantially encloses the first open end 28 of the first inner electrode 22, as well as the first open end 18 of the outer electrode 12, as best seen in FIG. 2. In the embodiment shown and described herein, the first end cap electrode 42 is provided with a recessed or stepped portion 64 which extends into the interior space 48 of the electrostatic shape-shifting ion optics 10 by an offset distance 70. The stepped portion 64 modifies or alters the electric field (e.g., 50, 52) that is produced within the interior space 48 when voltage functions are applied to the various electrodes 12, 22, 32, 42, and 44 comprising the electrostatic shape-shifting ion optics 10. More specifically, and as will be described in greater detail below, when the linear electric field 50 is produced within the electrostatic shape-shifting ion optics 10, the stepped portion 64 of first end cap electrode 42 bends or "pushes-in" the electric field lines 80 adjacent the end cap 42, thereby increasing the linearity of the electric field 50 along the length 14 of the outer electrode 12. See FIG. 3. The stepped portion 64 also improves the shape of the quadrupole field 54 illustrated in FIG. 4.

The particular shape or configuration of the first end cap electrode 42 will depend to a large degree on the overall shape or configuration of the outer electrode 12 as well as the first inner electrode 22, i.e., so that the first end cap electrode 42 substantially covers or encloses the first open ends 18 and 28 of the outer electrode 12 and first inner electrode 22. Accordingly, in one embodiment wherein the outer electrode 12 comprises a substantially cylindrically-shaped member, the first end cap electrode 42 comprises a substantially circularly-shaped member having a diameter 66 that is somewhat less than the diameter 56 of the first inner electrode 22. More specifically, the diameter 66 of first end cap electrode 42 should be about 93% of the outside diameter 56 of the first inner electrode 22. Thus, in one embodiment, the diameter 66 of the first end cap electrode 42 is selected to be about 112 mm.

Figure 3:
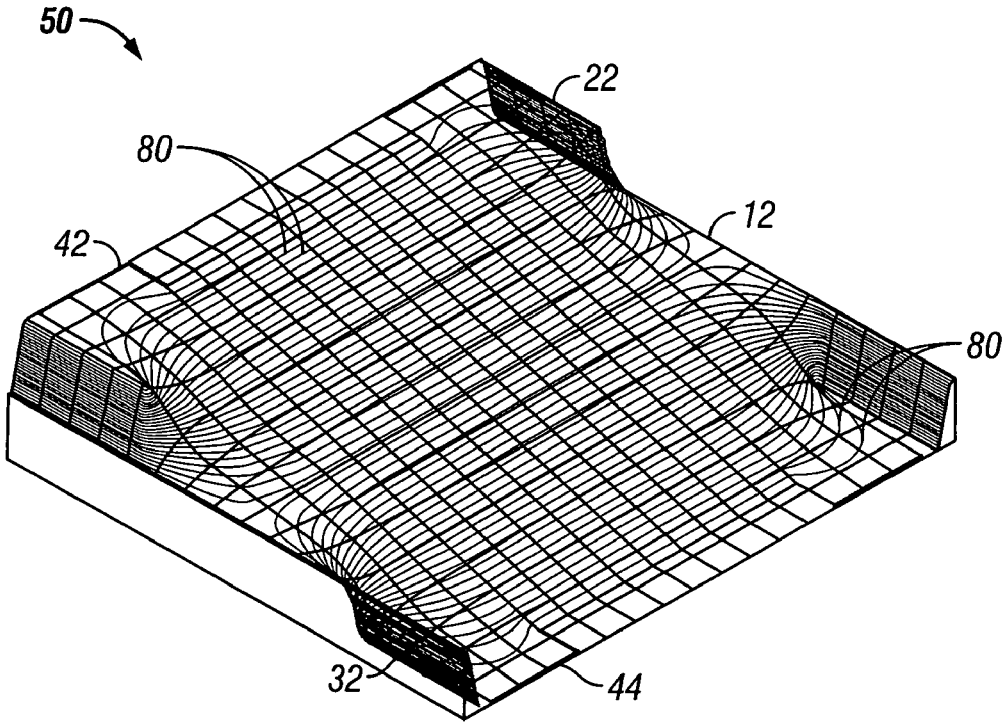
FIG. 3 is a computer-generated plot of a linear electric field produced by the electrostatic shape-shifting ion optic apparatus illustrated in FIG. 1.

The recessed or stepped portion 64 of first end cap electrode 42 will have a shape or configuration that depends to a large degree on the overall shape or configuration of the outer electrode 12 and first inner electrode 22, as well as on the particular degree of modification (e.g., field line bending) that is to be exerted on the electric field (e.g., linear field 50) by the stepped portion 64. For example, in the embodiment shown and described herein, the stepped portion 64 on the first end cap electrode 42 helps to increase the linearity of the linear field 50 as best seen in FIG. 3, thereby allowing the overall length 14 of the outer electrode 12 to be reduced. The stepped portion 64 also improves the shape of the quadrupole field 52 (illustrated in FIG. 4), enhancing the efficiency of the quadrupole field 52. The stepped portion 64 of first end cap electrode 42 has a diameter 68 that is about 61% of the overall diameter 66 of the first end cap electrode 42. The offset distance 70, i.e., the distance by which the stepped portion 64 extends into the interior space 48, is about 9% of the diameter 66 of the first end cap electrode 42. Thus, in one embodiment, the diameter 68 of the stepped portion 64 is about 68 mm and the offset 70 is about 10 mm.

The first end cap electrode 42 may be fabricated from any of a wide range of electrically conductive materials (e.g., metals and metal alloys) suitable for the intended application. Consequently, the present invention should not be regarded as limited to a first end cap electrode 42 fabricated from any particular material. However, it is generally preferred that the electrically conductive material not form an insulating surface layer of the type formed on many metals, such as aluminum. By way of example, in one embodiment, the first end cap electrode 42 is formed from a stainless steel alloy.

The wall thickness of the first end cap electrode 42 is not particularly critical, so long as the interior dimensions of the first end cap electrode 42 are sized in accordance with the teachings provided herein. By way of example, in one embodiment, the wall thickness of the material used to form the first end cap electrode 42 about 1 mm.

In the embodiment shown and described herein, the first end cap electrode 42 is formed from a screen-like material (e.g., electroformed screen) that is substantially transparent (e.g., having an ion transmissivity of about 97%) to ions. So fabricating the first end cap electrode 42 from an electroformed screen material will allow ions contained in the interior region 48 to be readily axially released through the first end cap electrode 42 at the appropriate time. Alternatively, the first end cap electrode 42 may be fabricated from a substantially solid, sheet-like material. The first end cap electrode 42 may then be provided with a suitable opening therein (not shown) to allow ions to be ejected through the first end cap electrode 42, if so desired, as would become apparent to persons having ordinary skill in the art after having become familiar with the teachings provided herein. In an alternative arrangement, the first end cap electrode 42 may comprise a solid material and may be electrically connected to detection electronics (not shown) such as a current amplifier and oscilloscope or electrometer and use the first end cap electrode 42 as a detection plate. Such an alternative arrangement would allow the electrostatic shape-shifting ion optics 10 to be used in mass spectrometry or ion-mobility spectrometry, depending on the pressure regime. In yet another arrangement, the first end cap electrode 42 could comprise a plurality of electrically isolated segments, allowing the electrostatic shape-shifting ion optics 10 to be utilized in ion diffusion processes.

The first end cap electrode 42 may be held in position with respect the outer electrode 12 and to the first inner electrode 22 by any of a wide variety of mounting arrangements that would be suitable for the intended application. Consequently, the present invention should not be regarded as limited to any particular arrangement for mounting the first end cap electrode 42 to the outer electrode 12 and/or the first inner electrode 22. However, it should be noted that the mounting arrangement for mounting the first end cap electrode 42 to the outer electrode 12 and/or the first inner electrode 22 should electrically insulate the electrodes 12, 22, and 42 if it is desired to place the electrodes 12, 22, and 42 at different electrical potentials. Because in most embodiments it will be desirable to place the to electrodes 12, 22, and 42 at different electrical potentials, it will be necessary to ensure that the arrangement for mounting the first end cap electrode 42 to the outer electrode 12 and/or the first inner electrode 22 provide the required degree of electrical insulation. By way of example, in one embodiment, the first end cap electrode 42 is secured in place by the insulating end cap 58. See FIG. 2.

The second end cap electrode 44 is similar to the first end cap electrode 42 and is positioned at about the second open end 40 of the second inner electrode 32. Accordingly, the second end cap electrode 44 substantially encloses the second open end 40 of the second inner electrode 32, as well as the second open end 20 of the outer electrode 12, as best seen in FIG. 2. In the embodiment shown and described herein, the second end cap electrode 44 is provided with a recessed or stepped portion 72 which extends into the interior space 48 of the electrostatic shape-shifting ion optics 10 by an offset distance 78. The stepped portion 72 modifies or alters the electric field (e.g., 50, 52) that is produced within the interior space 48 when voltage functions are applied to the various electrodes 12, 22, 32, 42, and 44 comprising the electrostatic shape-shifting ion optics 10. For example, and as will be described in greater detail below, when the linear electric field 50 is produced within the electrostatic shape-shifting ion optics 10, the stepped portion 72 of the second end cap electrode 44 bends or "pushes-in" the electric field lines 80 adjacent the end cap electrode 44, thereby increasing the linearity of the electric field 50. See FIG. 3. The stepped portion 72 also improves the shape of the quadrupole field 54 illustrated in FIG. 4.

Similar to the situation for the first end cap electrode 42, the particular shape or configuration of the second end cap electrode 44 will depend to a large degree on the overall shape or configuration of the outer electrode 12 as well as the second inner electrode 32, i.e., so that the second end cap electrode 44 substantially covers or encloses the second open ends 20 and 40 of the outer electrode 12 and second inner electrode 32. Accordingly, in one embodiment wherein the outer electrode 12 comprises a substantially cylindrically-shaped member, the second end cap electrode 44 comprises a substantially circularly-shaped member having a diameter 74 that is somewhat less than the diameter 62 of the second inner electrode 32. More specifically, the diameter 74 of second end cap electrode 44 should be about 93% of the outside diameter 62 of the second inner electrode 32. Thus, in one embodiment, the diameter 74 of the second end cap electrode 44 is about 112 mm.

The recessed or stepped portion 72 of the second end cap electrode 44 will have a shape or configuration that depends to a large degree on the overall shape or configuration of the outer electrode 12, the second inner electrode 32, as well as on the particular degree of modification (e.g., field line bending) that is to be exerted on the electric field (e.g., linear field 50) by the stepped portion 72. For example, in the embodiment shown and described herein, the stepped portion 72 on the second end cap electrode 44 helps to increase the linearity of the linear field 50 as best seen in FIG. 3, thereby allowing the overall length 14 of the outer electrode 12 to be reduced. The stepped portion 72 also improves the shape of the quadrupole field 52 (illustrated in FIG. 4), enhancing the efficiency of the quadrupole field 52. The stepped portion 72 of the second end cap electrode 44 has a diameter 76 that is about 61% of the overall diameter 74 of the second end cap electrode 44. The offset distance 78, i.e., the distance by which the stepped portion 72 extends into the interior space 48 of electrostatic shape-shifting ion optics 10, is about 9% of the overall diameter 74 of the second end cap electrode 44. Thus, in one embodiment, the diameter 76 of the stepped portion 72 is about 68 mm and the offset 78 is about 10 mm.

The second end cap electrode 44 may be fabricated from any of a wide range of electrically conductive materials (e.g., metals and metal alloys) suitable for the intended application. Consequently, the present invention should not be regarded as limited to a second end cap electrode 44 fabricated from any particular material. However, it is generally preferred that the electrically conductive material not form an insulating surface layer of the type formed on many metals, such as aluminum. By way of example, in one embodiment, the second end cap electrode 44 is formed from a stainless steel alloy.

The wall thickness of the second end cap electrode 44 is not particularly critical, so long as the interior dimensions of the second end cap electrode 44 are sized in accordance with the teachings provided herein. By way of example, in one embodiment, the wall thickness of the material used to form the second end cap electrode 44 about 1 mm.

In the embodiment shown and described herein, the second end cap electrode 44 is formed from a screen-like material having an ion transmissivity of about 97%. So fabricating the second end cap electrode 44 from a screen-like material will allow ions contained in the interior region 48 of electrostatic shape-shifting ion optics 10 to be readily axially released through the second end cap electrode 44 at the appropriate time. Alternatively, the second end cap electrode 44 may be fabricated from a substantially solid, sheet-like material. The second end cap electrode 44 may then be provided with a suitable opening therein (not shown) to allow ions to be ejected through the second end cap electrode 44, if so desired.

The second end cap electrode 44 may be mounted to the outer electrode 12 and/or the second inner electrode 32 in a manner similar to that used to mount the first end cap electrode 42. Consequently, the present invention should not be regarded as limited to any particular arrangement for mounting the second end cap electrode 44 to the outer electrode 12 and/or the second inner electrode 32. However, it should be noted that the arrangement for mounting the second end cap electrode 44 to the outer electrode 12 and/or the second inner electrode 32 should electrically insulate the electrodes 12, 32, and 44 if it is desired to place the electrodes 12, 32, and 44 at different electrical potentials. Because in most embodiments it will be desirable to place the electrodes 12, 32, and 44 at different electrical potentials, it will be necessary to ensure that the arrangement for mounting the second end cap electrode 44 to the outer electrode 12 and/or the second inner electrode 32 provide the required degree of electrical insulation. By way of example, in one embodiment, the second end cap electrode 44 is secured in place by the insulating end cap 58', as best seen in FIG. 2.

The insulating end caps 58 and 58' may be secured together by an outer housing 63 that extends between the insulating end caps 58 and 58'. The outer housing 63 may be provided with openings or cut-outs (not shown) therein in order to allow various ancillary components (also not shown) required or desired to operate the electrostatic shape-shifting ion optics 10. The outer housing 63 may comprise any of a wide range of configurations (e.g., cylindrical, hexagonal, square, etc.) and may be made from any of a wide range of materials (e.g., polycarbonate plastics) suitable for the intended application. However, because such an outer housing 63, if desired, could be easily provided by persons having ordinary skill in the art after having become familiar with the teachings provided herein, the particular outer housing 63 utilized in one embodiment of the invention will not be described in further detail herein.

As was briefly described above, the electrostatic shape-shifting ion optics 10 described herein is readily scalable to allow the electrostatic shape-shifting ion optics to be used to advantage in any of a wide variety of applications. For example, because the size of the ion "cloud" to be contained within the electrostatic shape-shifting ion optics is related to the pressure within the interior space 48, with higher pressures generally resulting in larger ion clouds, the electrostatic shape-shifting ion optics 10 may be readily enlarged to accommodate such larger ion clouds by simply increasing the dimensions (i.e., sizes) of the various electrodes comprising the electrostatic shape-shifting ion optics 10. In scaling the electrostatic shape-shifting ion optics, the ratios of the interior dimensions of the various electrodes must remain the same, including the annular gaps 54 and 60 as well as the thicknesses of the first and second inner electrodes 22 and 32, respectively. Because the interior dimensions includes the annular gaps 54 and 60 as well as the thicknesses of the first and second inner electrodes 22 and 32, because there are electric fields on both sides of the first and second inner electrodes 22 and 32, the annular gaps 54 and 60 as well as the thicknesses of the first and second inner electrodes 22 and 32 must be scaled as well. For example, if the overall size of the electrostatic shape-shifting ion optics 10 is to be doubled, then the sizes of the annular gaps 54 and 60 as well as the thicknesses of the first and second inner electrodes 22 and 32 must be doubled as well.

Each of the electrodes 12, 22, 32, 42, and 44 comprising the electrostatic shape-shifting ion optics 10 are connected to a voltage source 46. The voltage source 46 may be used to apply separate voltage functions to each of the various electrodes 12, 22, 32, 42, and 44 in order to produce or create an electric field having the desired properties within the interior space 48 of the electrostatic shape-shifting ion optics 10. In this regard it should be noted that it is generally preferred, but not required, that the voltage source 46 be capable of independently controlling the particular voltage functions that are applied to each of the electrodes 12, 22, 32, 42, and 44 to allow maximum control over the resulting electric field. However, it should be understood that the voltage source 46 need not be capable of applying different voltage functions to each of the electrodes if such independent control is not desired. Consequently, the present invention should not be regarded as limited to a voltage source capable of independently providing voltage functions to each of the individual electrodes 12, 22, 32, 42, and 44.

The voltage source 46 may comprise any of a wide range of voltage sources that are now known in the art or that may be developed in the future that are or would be suitable for providing the voltage functions to the electrodes in the manner described herein. In addition, because suitable voltage sources are known in the art and could be easily supplied by persons having ordinary skill in the art after having become familiar with the teachings provided herein, the particular voltage source 46 that may be utilized in one embodiment of the present invention will not be described in greater detail herein.

As was briefly described earlier, the particular voltage functions that may be applied to the various electrodes 12, 22, 32, 42, and 44 will depend on particular characteristics of the electric field or electric fields that are to be produced. In addition, the voltage functions to be applied may be time invariant (e.g., constant) or may vary with time, again depending on the particular characteristics that are desired for the electric field, as well as on the particular application in which the electrostatic shape-shifting ion optics 10 is to be used. Consequently, the present invention should not be regarded as limited to any particular voltage functions.

Any of a wide range of electric fields can be produced within the interior space 48 of the electrostatic shape-shifting ion optics 10 by varying the voltage functions that are provided by the voltage source 46 to the various electrodes 12, 22, 32, 42, and 44. One way for determining the shape of the resulting electric field is to use a computer program to model the electric field that would result from a given electrode geometry and for given applied voltage functions. Such a computer modeling process can be used to determine those modifications of the shapes of the electrodes and/or the voltage functions that may be applied to the electrodes in order to generate an electric field having the desired characteristics. As described herein, we have discovered that a electrostatic shape-shifting ion optics 10 having the electrode configurations described herein may be used to generate a wide variety of electric fields, ranging from linear (e.g., field 50), to quadrupolar (e.g, field 52), as well as higher-order quadrupolar fields (not shown), but without having to change or modify the physical shapes and configurations of the various electrodes 12, 22, 32, 42, and 44 comprising the variable mode ion source 10. Instead, the electric field can be changed or modified by simply changing the voltage functions that are applied by the voltage source 46 to the various electrodes 12, 22, 32, 42, and 44.

For example, and with reference now to FIG. 3, the voltage functions applied to the various electrodes 12, 22, 32, 42, and 44 may be selected to produce a linear electric field 50. The electric field depicted in FIG. 3 was generated by a computer modeling program known as "SIMION 7.0" which is available from Scientific Instruments Services, Inc., 1027 Old York Road, Ringoes, N.J. 08551 (USA). The computer modeling is based on the electrostatic shape-shifting ion optics 10 having the electrode configurations and dimensions shown and described herein. The electric potentials (e.g., voltage functions) placed on the various electrodes have the relative potentials depicted in FIG. 3 by reference to the relative vertical positions of the various electrodes. Thus, the linear electric field 50 illustrated in FIG. 3 may be produced by placing the second inner electrode 32 and second end cap electrode 44 at a base potential. By way of example, the base potential may be a ground potential, although this is not required. The first inner electrode 22 and the first end cap electrode 42 are placed at a higher potential. The outer electrode 12 is placed at a potential that is approximately midway between the potential of the first inner electrode 22 and the first end cap electrode 42 and the potential of the second inner electrode 32 and the second end cap electrode 44.

As mentioned above, the stepped portions 64 and 72 of the respective first and second end cap electrodes 42 and 44 assist in increasing the linearity of the linear electric field 50 near each respective end cap electrode 42 and 44 by "pushing in" the field lines 80. Thus, the computer modeling program may be used to verify that the offset distances 70 and 78 provided to the stepped portions 64 and 72 of the respective first and second end cap electrodes 42 and 44 provide the desired degree of linearity to the field 50.

The electric field (e.g., linear electric field 50) can be readily optimized for a particular operating regime (e.g., high-vacuum or atmospheric pressure) by simply varying (usually slightly) the voltage functions applied to the various electrodes 12, 22, 32, 42, and 44. Suitable modifications to the voltage functions may be arrived at, for example, by using the computer modeling program (e.g., SIMION 7.0) to model the electric field shape that would result from modifications to the various voltage functions. Alternatively, other methods, such an analytical methods or even trial-and-error, could be used to arrive at the appropriate voltage functions. Consequently, then the electrostatic shape-shifting ion optics 10 experiences greatly expanded utility over conventional ion traps wherein the electrodes are specifically shaped or designed for a particular operating regime.

A quadrupole electric field 52 may be easily produced by the electrostatic shape-shifting ion optics 10 by merely changing the voltage functions provided to the various electrodes 12, 22, 32, 42, and 44. The quadrupole electric field 52 depicted in FIG. 4 was also generated by the SIMION 7.0 computer modeling program and illustrates the shape of the electric field with the electrodes having the configurations and dimensions specified herein. The electric potentials (e.g., voltage functions) placed on the various electrodes have the relative potentials depicted in FIG. 4 by reference to the relative vertical positions of the various electrodes. Thus, the quadrupole electric field 52 may be produced by placing the outer electrode 12 at a base potential. By way of example, the base potential may be a ground potential, although this is not required. The first and second end cap electrodes 42 and 44 are both placed at a higher potential, with the first and second inner electrodes 22 and 32 together placed at an intermediate potential. By way of example, the intermediate potential may be approximately midway between the potential of outer electrode 12 and the potential of the first and second end cap electrodes 42 and 44.

As was the case for the linear electric field 50, the quadrupole electric field 52 and, indeed, any electric field produced within the interior space 48, can be readily optimized for a particular operating regime (e.g., high-vacuum or atmospheric pressure) by simply varying the voltage functions applied to the various electrodes 12, 22, 32, 42, and 44. Suitable modifications to the voltage functions may be arrived at, for example, by using the computer modeling program (e.g., SIMION 7.0) to model the electric field shape that would result from modifications to the various voltage functions in the manner already described.

Regardless of the particular type of electric field (e.g., linear field 50 or quadrupolar field 52) that is produced within the interior space 48, it is important to recognize that the electric field can be rapidly changed or altered to cause the ions under the influence of the electric field to be manipulated or controlled as desired. For example, the quadrupole electric field 52 may be used to confine radially injected ions within the interior space 48. Then, the electric field may be rapidly changed to another type of field, such as the linear field 50, to cause the ions to be axially ejected from one or both of the end cap electrodes 42 and 44.

In addition, the shape of the electric field can be altered to change the spatial distribution of ions contained within the interior space 48. For example, we have found that ions trapped within the oscillating quadrupolar field 52 tend to collect in a region near the geometric center of the field. The ions so collected tend to be in a generally spherical distribution. The generally spherical distribution of ions can be changed to a generally oblate distribution by changing the relative potentials placed on the electrodes to modify the shape of the oscillating fields. The distribution of ions may then be ejected axially from the end cap electrodes 42 and 44 by switching the potentials of the electrodes to create a linear field shape. Still other ion manipulations are possible with the electrostatic shape-shifting ion optics 10, as would become apparent to persons having ordinary skill in the art after having become familiar with the teachings provided herein. Consequently, the present invention should not be regarded as limited to the particular field shapes and ion manipulation processes shown and described herein.

Having herein set forth preferred embodiments of the present invention, it is anticipated that suitable modifications can be made thereto which will nonetheless remain within the scope of the invention.

The invention claimed is:

1. A electrostatic shape-shifting ion optics, comprising:

an outer electrode defining an interior region between first and second opposed open ends;

a first inner electrode positioned within the interior region of said outer electrode at about the first open end of said outer electrode;

a second inner electrode positioned within the interior region of said outer electrode at about the second open end of said outer electrode;

a first end cap electrode positioned at about the first open end of said outer electrode so that the first end cap electrode substantially encloses the first open end of said outer electrode;

a second end cap electrode positioned at about the second open end of said outer electrode so that the second end cap electrode substantially encloses the second open end of said outer electrode; and a voltage source operatively connected to each of said outer electrode, said first and second inner electrodes, and said first and second end cap electrodes, said voltage source applying voltage functions to each of said electrodes to produce an electric field within an interior space enclosed by said electrodes.

2. The electrostatic shape-shifting ion optics of claim 1, wherein the electric field produced within the interior space enclosed by said electrodes comprises a quadrupolar electric field.

3. The electrostatic shape-shifting ion optics of claim 1, wherein the electric field produced within the interior space enclosed by said electrodes comprises a linear electric field.

4. The electrostatic shape-shifting ion optics of claim 1, further comprising an ion source operatively associated with said outer electrode, said ion source injecting ions radially inwardly into the interior space enclosed by said electrodes.

5. The electrostatic shape-shifting ion optics of claim 1 wherein said electrodes comprise an electrically conductive material.

6. A electrostatic shape-shifting ion optics, comprising:

an outer electrode having a length, said outer electrode defining an interior region having first and second opposed open ends;

a first inner electrode having a length, said first inner electrode defining an interior region having first and second opposed open ends, the length of the first inner electrode being less than the length of said outer electrode, said first inner electrode being positioned within the interior region of said outer electrode at about the first open end of said outer electrode;

a second inner electrode having a length, said second inner electrode defining an interior region having first and second opposed open ends, the length of the second inner electrode being less than the length of said outer electrode, said second inner electrode being positioned within the interior region of said outer electrode at about the second open end of said outer electrode;

a first end cap electrode positioned at about the first open end of said first inner electrode so that said first end cap electrode substantially encloses the first open end of said first inner electrode;

a second end cap electrode positioned at about the second open end of said second inner electrode so that said second end cap electrode substantially encloses the second open end of said second inner electrode; and a voltage source operatively connected to each of said outer electrode, said first and second inner electrodes, and said first and second end cap electrodes, said voltage source applying voltage functions to each of said electrodes to produce an electric field within an interior space enclosed by said electrodes.

7. The electrostatic shape-shifting ion optics of claim 6, wherein the first open end of the first inner electrode is substantially aligned with the first open end of the outer electrode and wherein the second open end of the second inner electrode is substantially aligned with the second open end of the outer electrode.

8. The electrostatic shape-shifting ion optics of claim 6, wherein said outer electrode comprises a generally cylindrically shaped, hollow structure.

9. The electrostatic shape-shifting ion optics of claim 8, wherein said first and second inner electrodes comprise generally cylindrically shaped, hollow structures, the arrangement of said first and second inner electrodes within said outer electrode defining respective first and second annular gaps therebetween.

10. The electrostatic shape-shifting ion optics of claim 9, wherein the length of said outer electrode is about 120 mm, and wherein said outer electrode has an inside diameter of about 126 mm.

11. The electrostatic shape-shifting ion optics of claim 10, wherein the length of said first inner electrode is about 31 mm, and wherein said first inner electrode has an outside diameter of about 120 mm.

12. The electrostatic shape-shifting ion optics of claim 11, wherein the length of said second inner electrode is about 31 mm, and wherein said second inner electrode has an outside diameter of about 120 mm.

13. The electrostatic shape-shifting ion optics of claim 12, wherein the first and second annular gaps have thicknesses of about 3 mm.

14. The electrostatic shape-shifting ion optics of claim 9, wherein the length of said first inner electrode is about 26% of the length of said outer electrode, and wherein said first inner electrode has an outside diameter of about 95% of the inside diameter of said outer electrode.

15. The electrostatic shape-shifting ion optics of claim 9, wherein the length of said second inner electrode is about 26% of the length of said outer electrode, and wherein said second inner electrode has an outside diameter of about 95% of the inside diameter of said outer electrode.

16. The electrostatic shape-shifting ion optics of claim 9, wherein the first and second annular gaps have thicknesses of about 2% of the inside diameter of said outer electrode.

17. The electrostatic shape-shifting ion optics of claim 6, wherein said first end cap electrode includes a stepped portion extending into the closed region defined by said outer electrode and wherein said second end cap electrode includes a stepped portion extending into the closed region defined by said outer electrode.

18. The electrostatic shape-shifting ion optics of claim 17, wherein said first end cap electrode has a diameter and wherein said stepped portion of said first end cap electrode extends into the closed region defined by said outer electrode by a distance of about 9% of the diameter of the first end cap electrode and wherein said second end cap electrode has a diameter and wherein said stepped portion of said second end cap electrode extends into the closed region defined by said outer electrode by a distance of about 9% of the diameter of the second end cap electrode.

19. The electrostatic shape-shifting ion optics of claim 18, wherein the stepped portion of said first end cap electrode has a diameter that is about 61% of the diameter of the first end cap electrode and wherein the stepped portion of said second end cap electrode has a diameter of about 61% of the diameter of the second end cap electrode.

20. A method, comprising:

providing a electrostatic shape-shifting ion optics comprising:

an outer electrode having a length, said outer electrode defining an interior region having first and second opposed open ends;

a first inner electrode positioned within the interior region of said outer electrode at about the first open end of said outer electrode;

a second inner electrode positioned within the interior region of said outer electrode at about the second open end of said outer electrode;

a first end cap electrode positioned at about the first open end of said outer electrode so that said first end cap electrode substantially encloses the first open end of said outer electrode;

a second end cap electrode positioned at about the second open end of said outer electrode so that said second end cap electrode substantially encloses the second open end of said outer electrode; and applying a voltage function to each of said outer electrode, said first and second inner electrodes, and said first and second end cap electrodes to produce an electric field within an interior space enclosed by said electrostatic shape-shifting ion optics.

21. The method of claim 20, wherein applying a voltage function comprises applying a voltage function to each of said electrodes to produce a linear electric field.

22. The method of claim 20, wherein applying a voltage function comprises applying a voltage function to each of said electrodes to produce a quadrupolar electric field.

23. The method of claim 20, further comprising varying at least one voltage function to change the electric field.

* * * * *